US011585619B2

(12) United States Patent
Balhan et al.

(10) Patent No.: US 11,585,619 B2
(45) Date of Patent: Feb. 21, 2023

(54) FIRING PIN SAFETY OF A PISTOL

(71) Applicant: FN HERSTAL S.A., Herstal (BE)

(72) Inventors: Laurent Balhan, Mormont (BE); Dorian Delvaux, Oupeye (BE)

(73) Assignee: FN Herstal, S.A.

( * ) Notice: Subject to any disclaimer, the term of this patent is extended or adjusted under 35 U.S.C. 154(b) by 0 days.

(21) Appl. No.: 17/238,338

(22) Filed: Apr. 23, 2021

(65) Prior Publication Data

US 2021/0333059 A1 Oct. 28, 2021

(30) Foreign Application Priority Data

Apr. 23, 2020 (EP) ..... 20171206

(51) Int. Cl.
*F41A 17/24* (2006.01)
*F41A 17/72* (2006.01)
*F41A 17/64* (2006.01)

(52) U.S. Cl.
CPC ..... *F41A 17/72* (2013.01); *F41A 17/24* (2013.01); *F41A 17/64* (2013.01)

(58) Field of Classification Search
CPC ..... F41A 17/24; F41A 17/64
See application file for complete search history.

(56) References Cited

U.S. PATENT DOCUMENTS 4,590,697 A 5/1986 Ruger et al.
6,240,670 B1 * 6/2001 Findlay ..... F41A 17/64 42/70.11
8,966,803 B2 3/2015 Dietel et al.
2017/0167813 A1 * 6/2017 Gorcynski ..... F41A 17/24
2019/0390928 A1 * 12/2019 Curry ..... F41A 17/72

FOREIGN PATENT DOCUMENTS

EP 2525185 11/2021
WO 2017080537 5/2017

OTHER PUBLICATIONS

European Patent Office, European Search Report for EP 20 171 206.4, dated Sep. 25, 2020.

* cited by examiner

*Primary Examiner* — J. Woodrow Eldred
(74) *Attorney, Agent, or Firm* — Williams Mullen; Thomas F. Bergert

(57) ABSTRACT

The present invention relates to a pistol comprising a firing pin safety device integrated into a slide (5) of the pistol comprising a firing pin (1) comprising a lateral extension (25) comprising at least one safety lug (10,11) and a firing pin butterfly safety (2) positioned on an axis of rotation (27) fastened to the slide and parallel to the axis of translation of the firing pin (20), said butterfly safety (2) being able to rotate in a vertical plane between a firing position and a blocking position, said butterfly (2) comprising at least one bearing surface (17,18) on which the at least one lug (10,11) rests when said butterfly is in the blocking position and at least one recess (14) able to allow the at least one lug (10,11) to pass when said butterfly is in the shooting position, the center of mass of said butterfly (2) being on its axis of rotation (27) and the axis of rotation (27) being a main axis of inertia of said butterfly (2).

12 Claims, 3 Drawing Sheets

FIRING PIN SAFETY OF A PISTOL

RELATED APPLICATIONS

The following application claims priority to European Application No. 20171206.4 filed Apr. 23, 2020, the disclosure of which is incorporated herein by reference in its entirety.

OBJECT OF THE INVENTION

The present invention relates to a pistol firing pin safety device.

BACKGROUND OF THE INVENTION

For safety reasons, it is generally necessary in firearms to ensure that the firing pin can only strike a chambered cartridge when the trigger is actuated, even in case of fall, break or exaggerated wear of the trigger tail directly controlling the firing pin. This type of safety, called firing pin safety, is generally controlled by a translating or rotating part actuated by the control chain. This part is generally kept in the safety position by a spring.

Document WO2017/080537 describes such a device in which the blocking of the firing pin is ensured by a rotating part. The drawback of these devices is that the inertia of this blocking part can cause it to be unblocked under the effect of an impact, for example caused by a fall. Indeed, depending on the orientation of the fall, the inertia (both in rotation and in translation) can cause a movement of the firing pin safety and therefore a chance deactivation of the safety. This phenomenon can also appear simply during shooting. Now, it is precisely during such falls or such intensive shooting that the risk of accidental disengagement of the firing pin is high.

One object of the invention is therefore to improve the firing pin locking safety, in particular during accidental falls.

BRIEF DESCRIPTION OF THE INVENTION

A first aspect of the invention relates to a pistol comprising a firing pin safety device integrated into a slide of the pistol comprising a firing pin comprising at least one safety lug and a firing pin butterfly safety positioned on an axis of rotation fastened to the slide and parallel to the axis of translation of the firing pin, said butterfly safety being able to rotate in a vertical plane between a firing position and a blocking position, said butterfly comprising at least one bearing surface on which the at least one lug rests when said butterfly is in the blocking position, the center of mass of said butterfly being on its axis of rotation and the axis of rotation being a main axis of inertia of said butterfly.

According to preferred embodiments of the invention, the slide comprises one, or an appropriate combination of at least two, of the following features:

- said butterfly comprises at least one recess able to allow the at least one lug to pass when said butterfly is in the shooting position;
- said butterfly comprises two bearing surfaces positioned symmetrically about the axis of the butterfly and two symmetrical recesses;
- the firing pin comprises two lugs positioned on either side of a lateral extension of the firing pin;
- the pistol comprises resilient means such as a spring, a spring blade, a torsion spring or any convenient type of spring, bearing on the slide and keeping said butterfly in the blocking position;

- the slide is fastened to a frame comprising a control chain controlled by a trigger, said control chain actuating a firing pin safety trigger tail causing said butterfly to switch from the safety position to the firing position when said trigger is pressed, said firing pin safety trigger tail being positioned on a horizontal firing pin safety trigger tail axis which is perpendicular to the axis of the barrel and located on a main axis of inertia of the firing pin safety trigger tail;
- the firing pin safety trigger tail and the control chain are positioned such that the firing pin safety trigger tail is actuated before a firing pin trigger tail releasing the firing pin;
- the axis of rotation of the butterfly is located in a vertical plane below the axis of the firing pin;
- said butterfly is positioned at the end of travel of the firing pin, preventing the firing pin head from emerging from a breech face integrated into the slide;
- the firing pin comprises a lateral extension which includes the at least one lug.

LEGEND OF THE FIGURES

Figure 1:
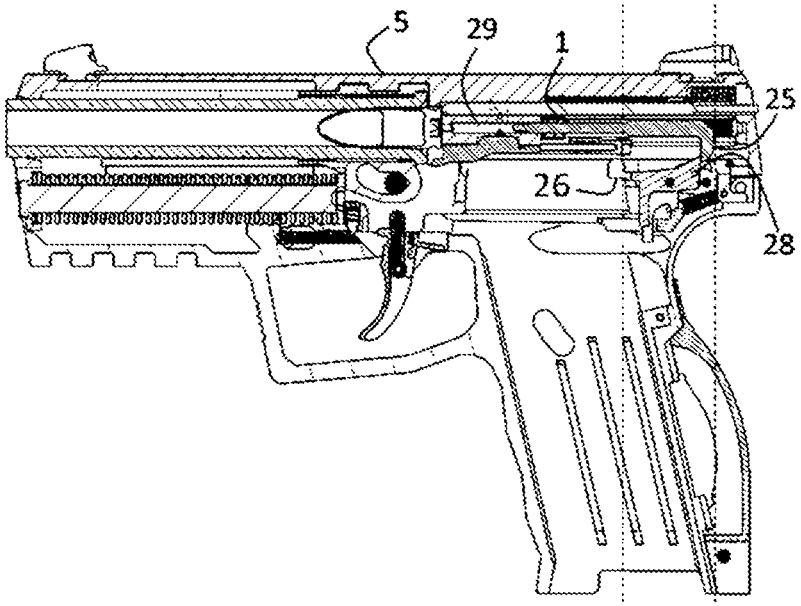
FIG. 1 shows a sectional view of an example pistol according to the invention.
Figure 2:
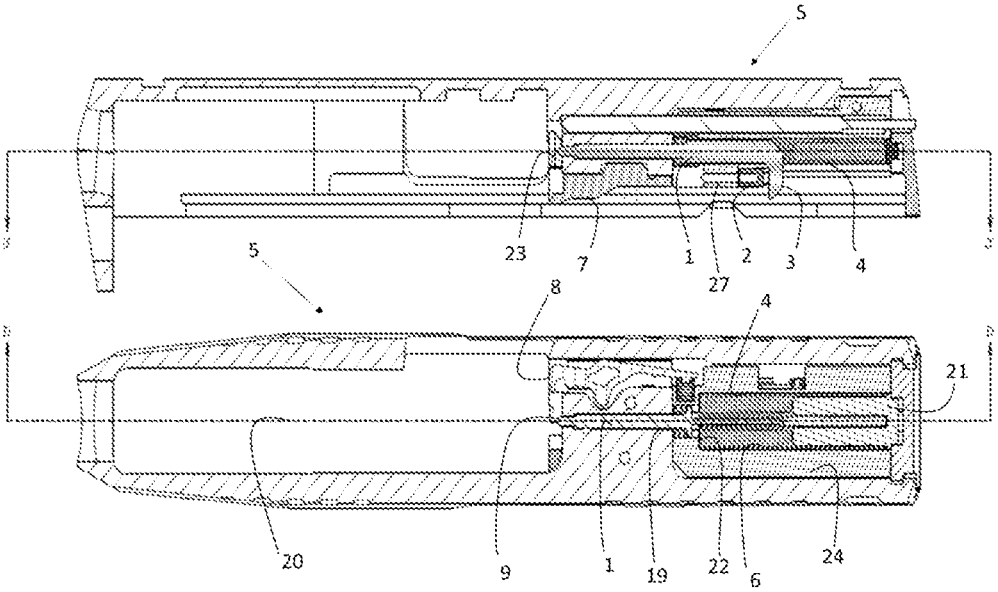
FIG. 2 shows a sectional top view and side view of a slide of a pistol according to the invention.
Figure 3:
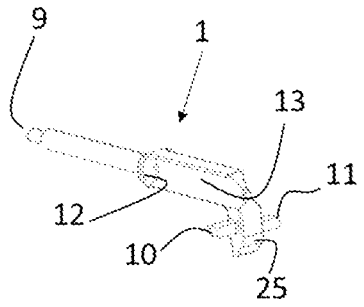
FIG. 3 shows a perspective view of a pistol firing pin according to the invention.

1. Firing pin
2. Firing pin lock (safety butterfly)
3. Firing pin stop
4. Right firing pin spring
5. Slide
6. Left firing pin spring
7. Slide insert
8. Extractor prong
9. Firing pin head
10. Left firing pin safety lug
11. Right firing pin safety lug
12. Spring bearing surface
13. Firing pin spring housing recess
14. Firing pin safety lug housing recess
15. Recess equivalent to the return spring housing in order to balance the butterfly
16. Return spring housing
17. Bearing surface of the right firing pin safety lug
18. Bearing surface of the left firing pin safety lug
19. Return spring of the firing pin
20. Firing pin axis
21. Spring support
22. Stop surface of the springs 4,6
23. Cartridge headspace bottom (or breech bottom or breech face)
24. Case
25. Lateral extension of the firing pin

26. Firing pin safety control trigger tail
27. Axis of rotation of the safety butterfly
28. Firing pin trigger tail
29. Guide channel of the firing pin
30. Firing pin stop surface during dry fire
31. Firing pin safety butterfly spring

DETAILED DESCRIPTION OF THE INVENTION

The present description essentially describes an example weapon implementing all of the aspects of the present invention. The person skilled in the art will easily understand that the various aspects of the invention, although usable separately, have synergies that will appear clearly in light of this example and of several described variants.

In the present description, a solid is said to be balanced when it rotates about a fixed axis if its center of mass is on the axis of rotation and the axis of rotation is a main axis of inertia for this solid.

According to the invention, the firing pin safety is no longer ensured by a mass in translation or in rotation along any axis, but by a firing pin safety butterfly 2 which is balanced on its axis of rotation 27. As a result, the absence of unbalance on the butterfly 2 ensures that an impact cannot cause it to rotate.

Figure 4:
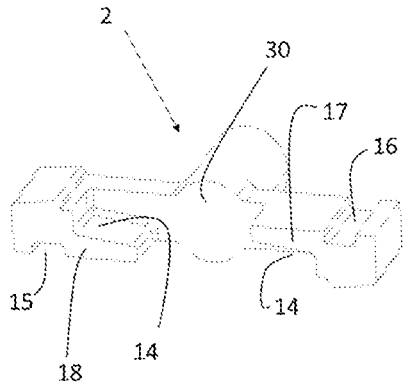
FIG. 4 shows a perspective view of a firing pin blocking safety butterfly.
Figure 5:
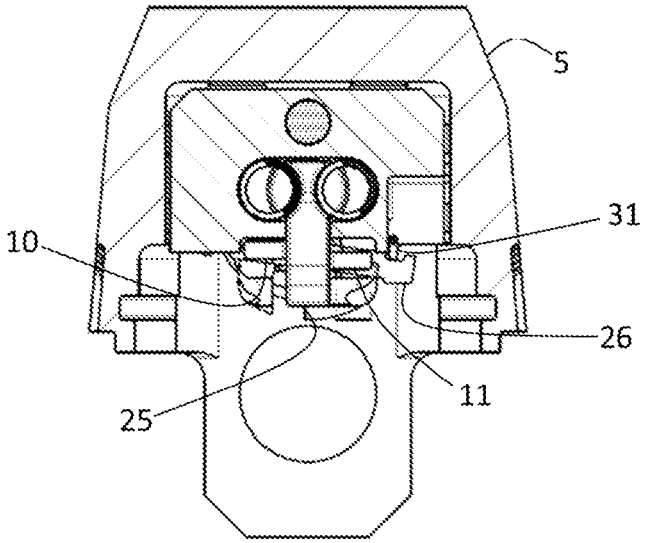
FIG. 5 shows a rear view of a section of the slide showing the firing pin safety butterfly in the safety position (the firing pin is shown in its entirety).

To this end, an example butterfly is shown in FIG. 4, which has a symmetry of rotation ensuring perfect balance. This butterfly comprises two bearing surfaces 17,18 on which two lugs 10,11 fastened on a lateral extension 25 of the firing pin 1 can bear when the butterfly 2 is in the safety position. The assembly, seen from the rear in the safety position, is shown in FIG. 5.

Figure 6:
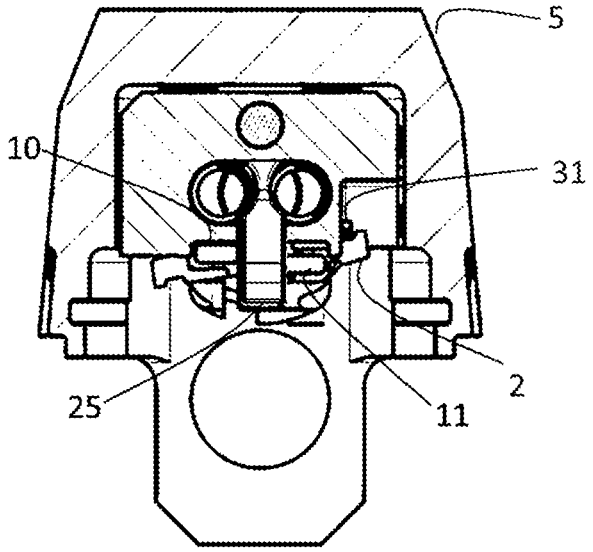
FIG. 6 shows a rear view of a section of the slide showing the firing pin safety butterfly in the shooting position (the firing pin is shown in its entirety).

When the trigger is actuated, a firing pin safety control trigger tail 26 pushes below the right lateral surface of the butterfly 2, so as to cause it to rotate on its axis 27. This rotation results in freeing the bearing surfaces 17,18 from the trajectory of the two lugs 10,11 of the firing pin 11, allowing the latter to continue its travel until it emerges from the breech face 23. The two lugs 10,11 are then placed in two housings 14 arranged in the butterfly. This positioning is shown, from the rear, in FIG. 6.

It is important to note that a single lug 10 or 11 suffices to block the firing pin on one of the surfaces, and that, while the illustrated part is symmetrical, it would also have been possible to imagine an asymmetrical part with the aforementioned elements on one side and a simple counterweight on the other side correcting the unbalance caused by said elements. Nevertheless, the use of a firing pin having a lug on each side makes it possible to balance the forces and to reduce the torque caused by the bearing of the firing pin 1 on the butterfly 2.

The butterfly 2 is advantageously kept in the safety position by one or several springs 31, typically a torsion spring bearing on the one hand on one (or two) grooves 15, 16 arranged on the lateral parts of the butterfly 2 and on the other hand on the slide 5.

Advantageously, the firing pin safety butterfly 2 is controlled by a firing pin safety trigger tail 26 fastened to the frame (or a chassis inserted into the frame) via a horizontal axis perpendicular to the axis of the barrel, this firing pin safety control trigger tail also being balanced on its axis so as to prevent an accidental control of the safety butterfly 2.

The release safety trigger can either be integrated into the firing pin release trigger 28, or be integrated into a separate part (as shown in FIG. 1).

Preferably, the shooting control chain actuated by the trigger is positioned so as to control the rotation of the firing pin safety butterfly 2 before releasing the firing pin 1. This sequence can either be obtained by a greater travel of the firing pin trigger tail 28, or more advantageously by using a separate firing pin safety trigger tail 26.

The invention claimed is:

1. A pistol comprising a firing pin safety device integrated into a slide of the pistol comprising a firing pin comprising at least one safety lug and a firing pin butterfly safety positioned on an axis of rotation secured to the slide and parallel to the axis of translation of the firing pin, said butterfly safety being able to rotate in a vertical plane between a firing position and a blocking position, said butterfly comprising at least one bearing surface on which the at least one lug rests when said butterfly is in the blocking position, the center of mass of said butterfly being on its axis of rotation wherein said safety butterfly comprises at least one recess able to allow the at least one lug to pass when said butterfly is in the shooting position.

2. The pistol according to claim 1, wherein the axis of rotation of the firing pin safety butterfly is a main axis of inertia of said firing pin safety butterfly.

3. The pistol according to claim 1, wherein said butterfly comprises two bearing surfaces positioned symmetrically about the axis of the butterfly and two symmetrical recesses.

4. The pistol according to claim 3, wherein the firing pin comprises two lugs positioned on either side of a lateral extension of the firing pin.

5. The pistol according to claim 1, comprising resilient means bearing on the slide and keeping said butterfly in the blocking position.

6. The pistol according to claim 1, wherein the slide is fastened to a frame or a chassis comprising a control chain controlled by a trigger, said control chain actuating a firing pin safety trigger tail causing said butterfly to switch from the safety position to the firing position when said trigger is pressed, said firing pin safety trigger tail being positioned on a horizontal firing pin safety trigger tail axis which is perpendicular to the axis of the barrel and passing through the center of mass of the firing pin safety trigger tail.

7. The pistol according to claim 6, wherein the firing pin safety trigger tail and the control chain are positioned such that the firing pin safety trigger tail is actuated before a firing pin trigger tail releasing the firing pin.

8. The pistol according to claim 1, wherein said axis of rotation of the butterfly is located in a vertical plane below the axis of the firing pin.

9. The pistol according to claim 1, wherein said butterfly is positioned at the end of travel of the firing pin, preventing the firing pin head from emerging from a breech face integrated into the slide.

10. The pistol according to claim 1, wherein the firing pin comprises a lateral extension which includes the at least one lug.

11. The pistol according to claim 1, wherein the firing pin safety trigger tail is secured to a firing pin trigger tail controlling the release of the firing pin.

12. The pistol according to claim 1, wherein the firing pin safety butterfly comprises a firing pin stop surface making it possible to stop the firing pin when no cartridge is chambered.

* * * * *